US009061310B2

(12) United States Patent
Seiz

(10) Patent No.: US 9,061,310 B2
(45) Date of Patent: Jun. 23, 2015

(54) VALVE UNIT FOR A COATING INSTALLATION

(75) Inventor: Bernhard Seiz, Lauffen (DE)

(73) Assignee: Durr Systems GmbH, Bietigheim-Bissingen (DE)

( * ) Notice: Subject to any disclaimer, the term of this patent is extended or adjusted under 35 U.S.C. 154(b) by 350 days.

(21) Appl. No.: 13/634,042

(22) PCT Filed: Mar. 2, 2011

(86) PCT No.: PCT/EP2011/001037

§ 371 (c)(1),
(2), (4) Date: Sep. 11, 2012

(87) PCT Pub. No.: WO2011/110304

PCT Pub. Date: Sep. 15, 2011

(65) Prior Publication Data

US 2013/0001326 A1 Jan. 3, 2013

(30) Foreign Application Priority Data

Mar. 11, 2010 (DE) ..... 10 2010 011 064

(51) Int. Cl.

| | |
|---|---|
| ***B05B 1/30*** | (2006.01) |
| ***B05B 12/14*** | (2006.01) |
| *B05B 5/04* | (2006.01) |
| *B05B 5/047* | (2006.01) |

(52) U.S. Cl.

CPC ..... *B05B 12/149* (2013.01); *B05B 5/04* (2013.01); *B05B 5/047* (2013.01); *B05B 12/1409* (2013.01)

(58) Field of Classification Search

CPC ..... F16K 27/00; B05B 1/30
USPC ..... 239/583, 569, 398, 400, 407, 413, 433, 239/427.3, 427.5, 428
See application file for complete search history.

(56) References Cited

U.S. PATENT DOCUMENTS

| | | | | |
|---|---|---|---|---|
| 3,373,762 | A * | 3/1968 | Korchak | 137/240 |
| 3,870,233 | A * | 3/1975 | Wilhelm et al. | 239/692 |
| 4,163,523 | A * | 8/1979 | Vincent | 239/305 |
| 4,567,912 | A * | 2/1986 | Levine | 137/606 |
| 4,592,305 | A * | 6/1986 | Scharfenberger | 118/677 |
| 4,714,179 | A * | 12/1987 | Otterstetter et al. | 222/148 |
| 4,846,226 | A * | 7/1989 | Merritt | 137/871 |
| 6,284,047 | B1 | 9/2001 | Yoshida et al. | |
| 6,858,340 | B2 * | 2/2005 | Sugawara et al. | 429/443 |
| 8,636,029 | B2 * | 1/2014 | Ott et al. | 137/606 |
| 2003/0234300 | A1 * | 12/2003 | Diana | 239/305 |
| 2005/0029368 | A1 * | 2/2005 | Giulano | 239/548 |
| 2006/0038154 | A1 * | 2/2006 | Fukano et al. | 251/321 |
| 2010/0012025 | A1 * | 1/2010 | Herre et al. | 118/300 |

FOREIGN PATENT DOCUMENTS

| | | |
|---|---|---|
| DE | 3534269 A1 | 4/1987 |
| DE | DD276038 | 3/1988 |

(Continued)

OTHER PUBLICATIONS

International Search Report, PCT/EP2011/001037, Dated Jul. 11, 2011.

*Primary Examiner* — Justin Jonaitis
(74) *Attorney, Agent, or Firm* — Bejin Bieneman PLC

(57) ABSTRACT

A valve unit for a coating system, for example an integrated color changer or two-component mixer in a rotary sprayer, is disclosed. An exemplary valve unit includes a housing and at least one valve receptacle arranged in the housing, and serves to receive a valve. The housing includes at least one first housing part and one second housing part, wherein the first housing part is formed of a different material than the second housing part.

19 Claims, 4 Drawing Sheets

(56) References Cited

FOREIGN PATENT DOCUMENTS

| | | | |
|---|---|---|---|
| DE | 69827611 | T2 | 11/2005 |
| DE | 102005033191 | A1 | 2/2006 |
| EP | 2110177 | B1 | 8/2010 |
| WO | WO2007131636 | A1 | 11/2007 |
| WO | WO-2008071273 | A2 | 6/2008 |
| WO | WO2008071273 | A2 | 6/2008 |

* cited by examiner

VALVE UNIT FOR A COATING INSTALLATION

CROSS-REFERENCES TO RELATED APPLICATIONS

This application is a National Stage application which claims the benefit of International Application No. PCT/EP2011/001037 filed Mar. 2, 2011, which claims priority based on German Application No. DE 10 2010 011 064.7, filed Mar. 11, 2010, both of which are hereby incorporated by reference in their entireties.

BACKGROUND

The present disclosure relates to a valve unit for a coating installation, e.g. an integrated colour changer or two-component mixer in a rotary atomizer.

A rotary atomizer with an Integrated Colour Changer (ICC) is known from WO 2007/131636 A1 and corresponding U.S. Pat. Pub. No. 2009/0158998A1, wherein the colour changer is structurally integrated into the housing of the rotary atom-izer. Furthermore, an annular design for a colour changer of this type is known from WO 2008/071273 A2 and corresponding U.S. Pat. Pub. No. 2010/0012025A1, wherein the colour changer is formed by a valve unit which is accommodated in a housing. The known valve unit here essentially consists of a central coating agent channel, into which a plurality of coating agent supply lines open, wherein the feed from the individual coating agent supply lines into the central coating agent channel is controlled by radially running needle valves. The housing of the valve unit usually consists of plastic (e.g. POM: polyoxymethylene), wherein the valve receptacles, the valve seats, the central coating agent channel and the coating agent supply lines are constructed in the housing of the valve unit, which consists of plastic. The conventional design of the valve unit with a housing consisting completely of plastic has various disadvantages however, which are briefly explained in the following.

One disadvantage of this conventional design consists in the plastic of the housing only having an unsatisfactory material resistance with respect to the paints and rinsing agents used, as the paints or rinsing agents can attack the plastic and degrade the material over time.

A further disadvantage of the previously described conventional design of a valve unit consists in a material thickness of the housing of a spacing, in one case at least 2 millimeters (mm), having to be maintained between the adjacent valve receptacles in the housing of the valve unit, in order to ensure a satisfactory stability. This has the disadvantage, however, that the packing density of the valves in the housing is limited, which is disadvantageous in particular in the case of a structural integration of the valve unit into a rotary atomizer, as the available installation space is limited there.

A further disadvantage of the previously described conventional design of a valve unit is of significance in particular if the valve unit is not used as a colour changer, but rather as a two-component mixer, in order to mix a base paint with a hardener. Here, the valve unit must namely be cleaned regularly in order to prevent the base paint from hardening within the valve unit, which would lead to a total loss of the valve unit. This cleaning of the valve unit, however, holds the danger that the valve seat is damaged or even destroyed by means of the cleaning process.

A valve unit with two housing parts, which both consist of plastic however, is known from U.S. Pat. No. 3,870,233.

Further, painting installation components are known from DD 276 038 A5 (and corresponding U.S. Pat. Nos. 4,955,960 and 5,085,373), DE 698 27 611 T2 (and corresponding U.S. Pat. No. 6,284,047 B1), DE 10 2005 033 191 A1 (and corresponding U.S. Pat. No. 7,712,484 B2), and EP 2 110 177 B1 (and corresponding U.S. Pat. Pub. Nos. 2008/0121740A1, 2009/0026293A1, 2009/0032625A1, and 2010/0193613A1), which to some extent consist of different materials. However, these references are not concerned with valve units such as those described herein according to the exemplary illustrations.

Accordingly, there is a need for a correspondingly improved valve unit.

BRIEF DESCRIPTION OF THE FIGURES

While the claims are not limited to the specific illustrations described herein, an appreciation of various aspects is best gained through a discussion of various examples thereof. Referring now to the drawings, illustrative examples are shown in detail. Although the drawings represent the exemplary illustrations, the drawings are not necessarily to scale and certain features may be exaggerated to better illustrate and explain an innovative aspect of an illustration. Further, the exemplary illustrations described herein are not intended to be exhaustive or otherwise limiting or restricting to the precise form and configuration shown in the drawings and disclosed in the following detailed description. Exemplary illustrations are described in detail by referring to the drawings as follows:

DETAILED DESCRIPTION

Figure 1:
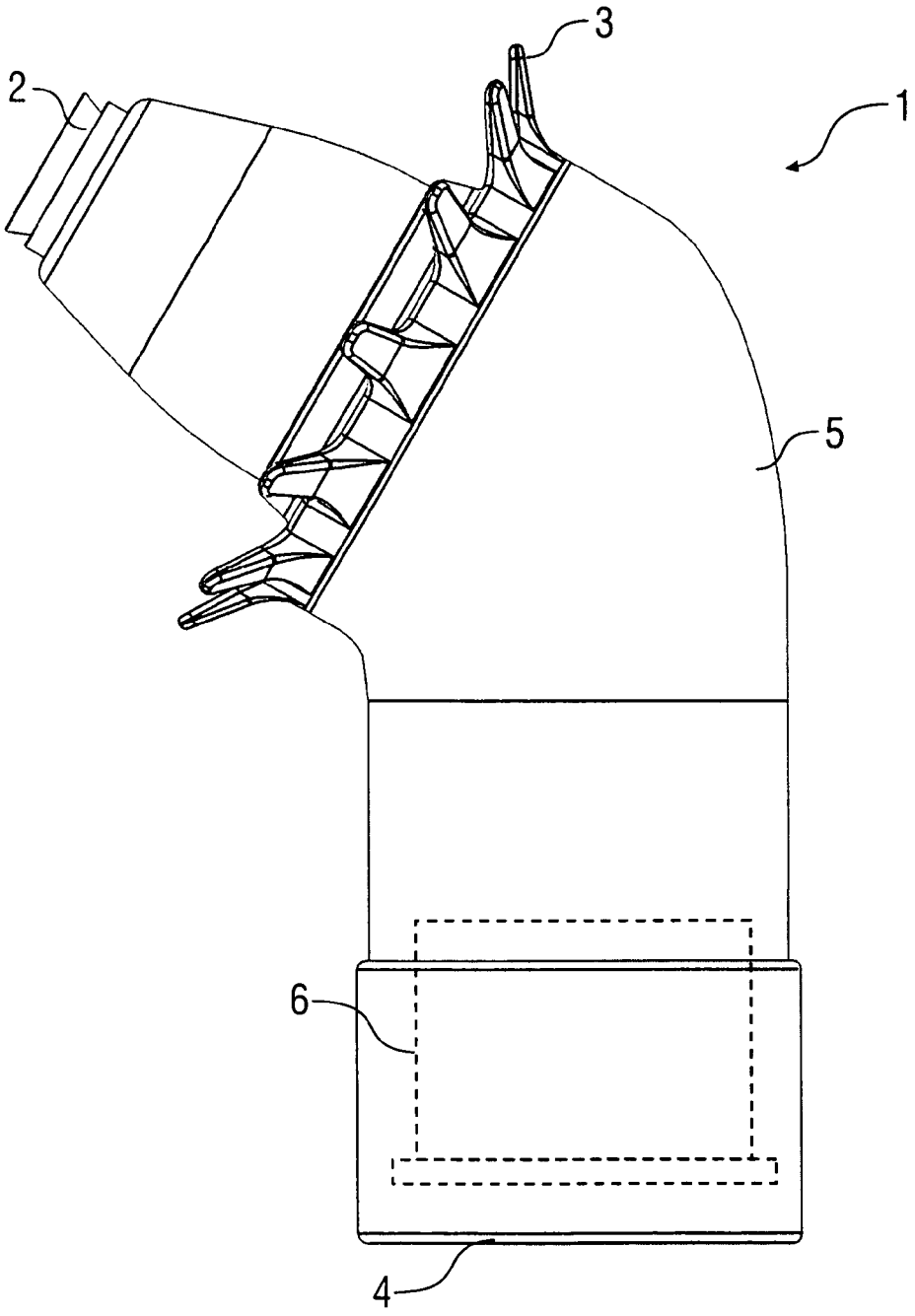
FIG. 1: a side view of a rotary atomizer according to an exemplary illustration, with a structurally integrated valve unit which is used as colour changer.
Figure 2:
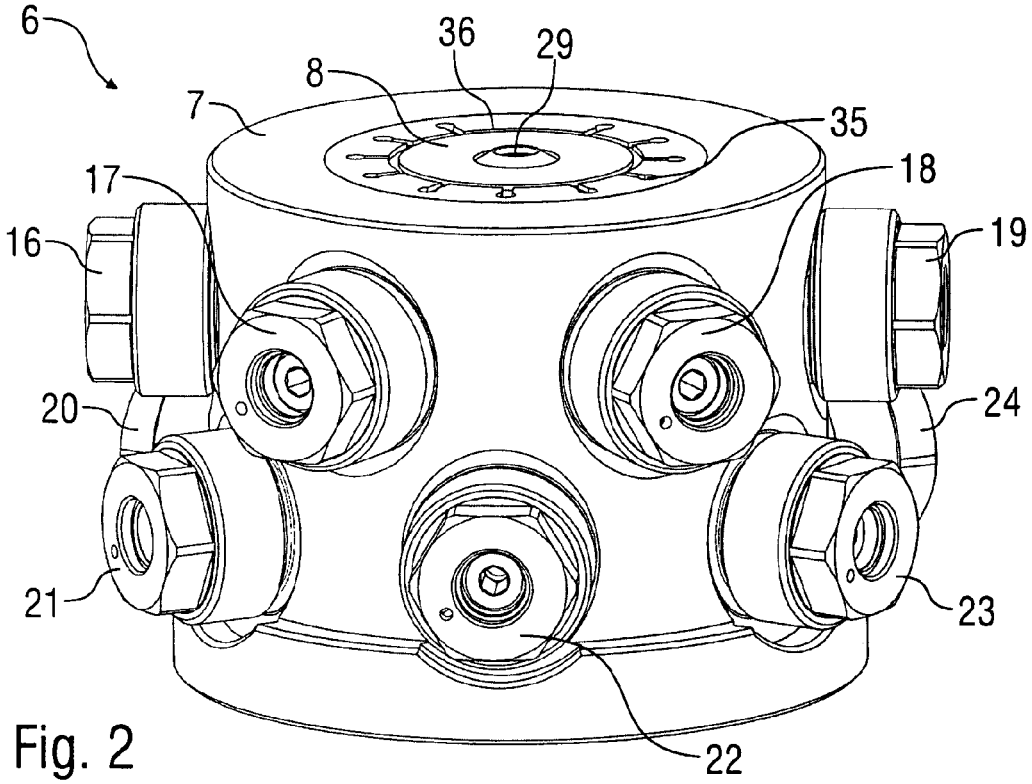
FIG. 2: a perspective view of the exemplary valve unit of the rotary atomizer from FIG. 1 with inserted valves.
Figure 3:
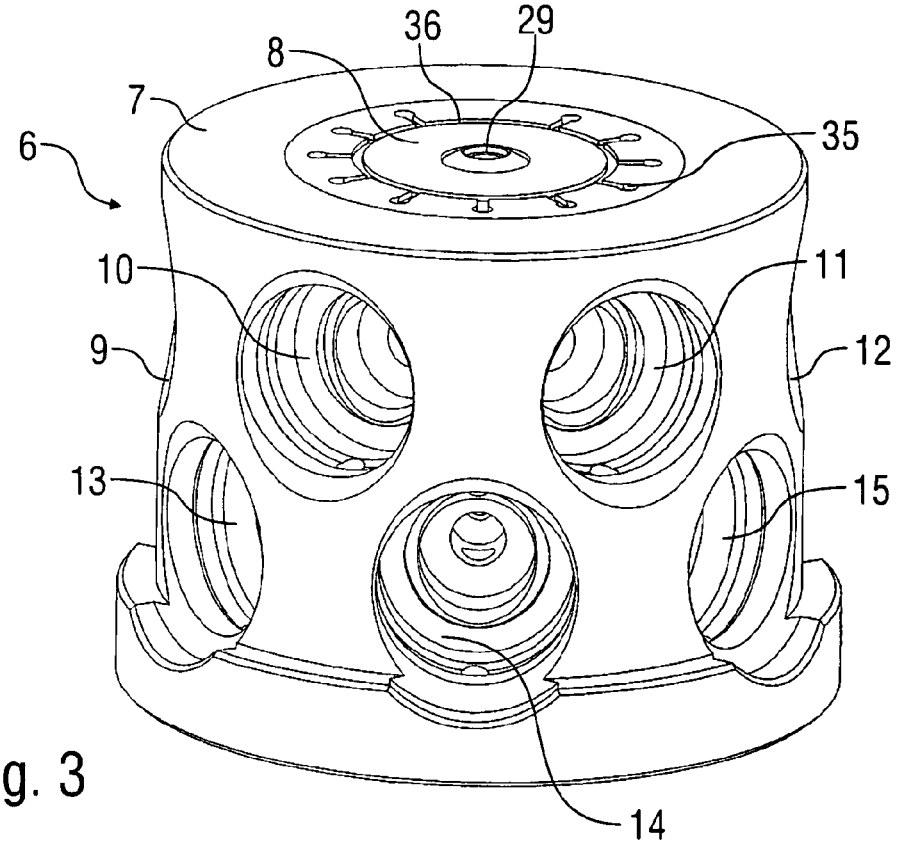
FIG. 3: a perspective view of the exemplary valve unit of the rotary atomizer from FIG. 2 without the valves.

The exemplary illustrations comprise the general technical teaching of assembling the housing of the valve unit from various housing parts which consist of different materials, so that the materials can be optimized with regards to the function of the respective housing part.

Thus, the housing of the valve unit can for example consist of a housing core and a housing jacket which surrounds the housing core.

The housing core can then, for example, consist of a high-grade steel and accommodate the valve seat and the media lines, wherein the choice of high-grade steel for the housing core offers various advantages. On the one hand, high-grade steel is substantially harder than the conventionally used plastic, so that when cleaning the housing, there is not a risk that the valve seat located in the housing core is damaged by the cleaning process. On the other hand, high-grade steel is also substantially more material-resistant to the conventionally used paints and rinsing agents, thereby more effectively resisting damage from the presence of the paints and rinsing agents.

The housing jacket by contrast may consist of plastic (e.g. POM: polyoxymethylene), as a result of which the over-all weight of the conventional valve unit is only slightly greater than the overall weight of conventional valve units, the housing of which may consist completely of a plastic material.

Generally, it may be said that a housing part (e.g. the housing core) may consist of a harder, more abrasion resistant, more rinsing agent resistant and/or more paint resistant material than the other housing part (e.g. the housing jacket). This generally also means that a housing part (e.g. housing core) may consist of an electrically conductive material, whereas the other housing part (e.g. housing jack-et) may generally consist of an electrically insulating materi-al. It may be particularly advantageous for the material of the housing jacket to have a density or weight which is as low as possible, which is particularly important if the valve unit is desired to be integrated into a rotary atomizer, as the rotary atomizer is generally guided in a highly manoeuvrable manner by a multi-axial painting robot, so that the robot dynamics would be impaired by a high weight of the rotary atomizer. The housing jacket consequently may consist of a substantially lighter material than the housing core. In one exemplary illustration, the mass density of the material of the housing jacket is less than 50%, 30%, 20% or even 10% of the mass density of the housing core.

Furthermore, there is also the option in the context of the exemplary illustrations for the housing jacket to consist of a transparent material which allows a visual inspection through the housing jacket.

A valve seat for a valve needle of the valve, which may be accommodated by the valve receptacle of the valve unit, may be located in the one housing part (e.g. the housing core). Furthermore, this housing part may contains all media-conveying lines of the valve unit, such as, for example, a central coating agent channel, coating agent supply lines which open via a valve into the central coating agent channel, and also corresponding leakage lines which emanate from the valve receptacles. This housing part therefore may contain all components of the valve unit which may profit from a material different from plastic being selected.

The other housing part (e.g. the housing jacket) may, by contrast, conventionally contain a pneumatic control line for controlling the valve. The exemplary illustrations are not limited to pneumatic valves with regards to the control, however, but rather may fundamentally also be realized with electrically or magnetically actuated valves or even with mechanically controlled valves, merely as examples.

In one exemplary illustration, the housing of the valve unit has a plurality of valve receptacles for receiving one valve in each case, wherein the valve receptacles in each case extend through both housing parts (e.g. housing core and housing jacket). The production of the housing core from a different material than plastic here offers the possibility of increasing the packing density of the valves, so that only one wall thickness, may remain between the adjacent valve receptacles in the housing. In one exemplary illustration, the one wall thickness may be smaller than 2 millimeters (mm), 1.5 mm, 1 mm, 0.75 mm or 0.5 mm.

Further, the individual valve receptacles may in each case have a leakage line which emanates from the respective valve receptacle. The leakage line may likewise run within the housing part (e.g., housing core), which is not formed or, or does not consist of, plastic.

In one exemplary illustration, these leakage lines run at acute angles to the central axis of the valve unit, wherein the leakage lines emanate from the individual valve receptacles and open in a first end face of the valve unit. The first end face may be the bell-cup side end face of the valve unit. Furthermore, the valve unit may have an annular collection channel which is arranged in the first end face of the valve unit, wherein the leakage lines open into this annular collection channel.

It can already be seen from the previous description that the exemplary illustrations are directed to a valve unit without valves, which can be inserted into the corresponding valve receptacles as replacement parts. Furthermore, the exemplary illustrations also comprise a complete valve unit with the valves inserted into the valve receptacles, wherein the valves are fixed in the respective valve receptacles, for example by means of a standards-compliant screw connection or by means of a screw connection with a special thread. Further fixing possibilities include, merely as examples, a plug connection or a bayonet closure.

Furthermore, the valve receptacle may be formed directly by the housing so that the inserted valve comes into direct physical contact with the material of the housing. A distinction is to be made for designs in which an insert, which then forms the valve receptacle, is inserted into the housing, wherein the material of the housing is less important.

Furthermore, the media-conveying lines (e.g. coating agent supply line, central coating agent channel, leakage line) may also be formed directly by the housing part which does not consist of plastic, so that the fluid (e.g. paint, rinsing agent) passed through comes into direct physical contact with the material of the housing, for which reason plastic is less suitable. The pneumatic control line for controlling the valve may by contrast be arranged in the housing part (e.g. housing jacket) consisting of plastic, as the material selection is less important here.

Further, the exemplary illustrations allow a high packing density of the valves within the valve unit. Thus, the exemplary valve unit may have more than 4, 6, 8, 10 or even more than 11 valve receptacles. Furthermore, the packing density of the valves within the valve unit can be greater than 0.01 cubic centimeters ($cm^3$) or 0.02 $cm^3$, which corresponds to 10,000 or 20,000 valves per cubic meter housing volume, respectively.

In one example, the housing of the valve unit is essentially rotationally symmetrical, for example in the shape of a cylinder. Here, the valve receptacles are arranged in the external surface of the housing and essentially orientated radially, so that the valves can be inserted radially into the valve receptacles.

The individual valve receptacles may be arranged in a distributed manner at a certain angular spacing with respect to one another over the circumference of the housing, wherein the angular spacing between the adjacent valve receptacles may be constant over the circumference of the housing. In the case of a distribution of 6 valve receptacles over the circumference of the cylindrical housing, the angular spacing between the adjacent valve receptacles may be 60°.

In the case of a larger number of valve receptacles, the valve receptacles may be arranged in a plurality of planes one above the other, wherein the valve receptacles are arranged in the adjacent planes, e.g., in an angularly offset manner with respect to one another. In one exemplary illustration, the valve receptacles are arranged in the adjacent planes in an angularly offset manner with respect to one another, specifically by half of the angular spacing which lies between the adjacent valve receptacles in the same plane. In the case of two valve planes with 6 valve receptacles in each case, the angular spacing between the adjacent valve receptacles in the same valve plane is therefore 60°, so that the star-shaped valve arrangements in the adjacent valve planes are offset by 30° with respect to one another, in order to enable an increased packing density of the valves.

Furthermore, the housing core may have a central coating agent channel in the exemplary illustrations, and a plurality of coating agent supply lines, wherein the valves control the feed from the individual coating agent supply lines into the central coating agent channel. A valve may therefore be assigned to each coating agent supply line, which valve controls the feed from the respective coating agent supply line into the central coating agent channel. The central coating agent channel in this case may open out in a first end face of the valve unit, which may be the bell-cup side end faces of the valve unit. The coating agent supply lines by contrast may open out in an opposite second end face of the valve unit, which may be the robot-side or connection-flange-side end face of the valve unit. Here, the central coating agent channel and/or the coating agent supply line may run axially in the housing.

Furthermore, the exemplary illustrations are not only directed to the previously described exemplary valve unit as an individual component, but also for an atomizer, e.g., a rotary atomizer, with a structurally integrated valve unit of this type.

In a variant of an atomizer of this type, the integrated valve unit is used as colour changer and therefore has a plurality of colour inlets and one colour outlet. In another example, the structurally integrated valve unit is by contrast used as a two-component mixer in order to supply a base paint and a hardener and to mix the same in the atomizer.

Finally, the exemplary illustrations also include a painting robot or a painting machine (e.g. side machine, roof machine) with an atomizer of this type.

Turning now to FIG. 1, a side view of a rotary atomizer 1 according to an exemplary illustration is shown. The rotary atomizer 1 may, for example, be used for painting motor vehicle body components. The rotary atomizer 1 has a rotating bell cup 2 as spray element, wherein the bell cup 2 is driven in by a turbine.

Furthermore, the rotary atomizer 1 has an external charging ring 3 in order to electrostatically charge the sprayed coating agent, so that the coating agent is deposited better on the electrically earthed or grounded components.

The rotary atomizer 1 can be fastened on a connection flange 4 on a hand axis of a multi-axial painting robot in any manner that is convenient.

Furthermore, the rotary atomizer 1 has a housing 5 in which an exemplary valve unit 6 is accommodated, wherein the valve unit 6 is used as integrated colour changer (ICC) and is subsequently described with reference to the FIGS. 2 to 5.

The valve unit 6 may have an essentially cylindrical housing which consists of a cylindrical housing jacket 7 made from plastic (e.g. POM: polyoxymethylene) and a likewise cylindrical housing core 8 made from high-grade steel, wherein the housing core 8 is inserted into the housing jacket 7 so that the housing jacket 7 surrounds the housing core 8.

A plurality of valve receptacles 9-15 may be located in the housing of the valve unit 6. The valve receptacles 9-15 may be arranged in a distributed manner in two valve planes above one another and over the circumference of the housing. Only the valve receptacles 9-15 are specifically illustrated in the drawings, but six further valve receptacles are located on the non-visible rear side of the valve unit, so that the valve unit 6 has eleven valve receptacles in total.

In this exemplary illustration, six valve receptacles 13-15 are located in the lower valve plane, which are arranged in a distributed manner at an angular spacing of 60° with respect to one another over the circumference of the cylindrical housing of the valve unit 6.

By contrast, only five valve receptacles 9-12, which are likewise arranged in a distributed manner at an angular spacing of 60° with respect to one another over the circumference of the housing, are located in the upper valve plane.

The valve receptacles 9-15 therefore may be arranged in a star-shaped manner both in the upper valve plane and in the lower valve plane, wherein the star-shaped arrangements in both valve planes are offset by 30° with respect to one another, in order to enable an increased packing density. Thus, the valve receptacle 10 in the upper valve plane is offset by 30° with respect to the adjacent valve receptacle 14 in the lower valve plane. This offers the advantage that the two adjacent valve receptacles 10, 14 do not have to keep to any axial distance, which enables a large packing density.

Figure 4:
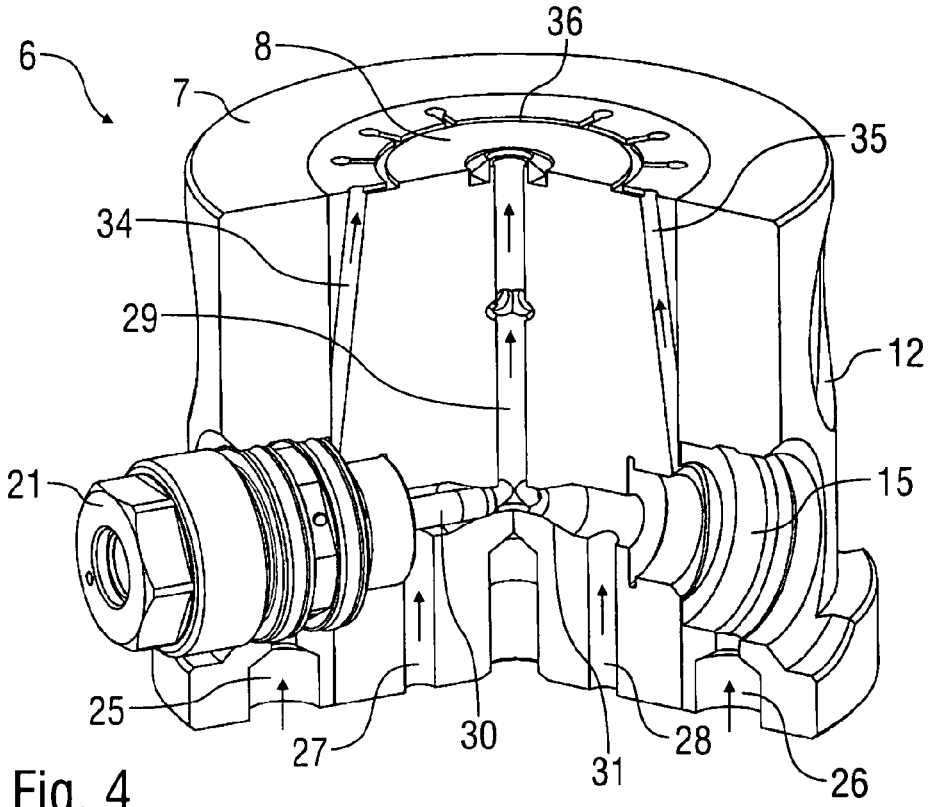
FIG. 4: a partially cut away perspective view of the exemplary valve unit from FIGS. 2 and 3, wherein one valve receptacle is empty, whilst a valve is inserted into the other valve receptacle.
Figure 5:
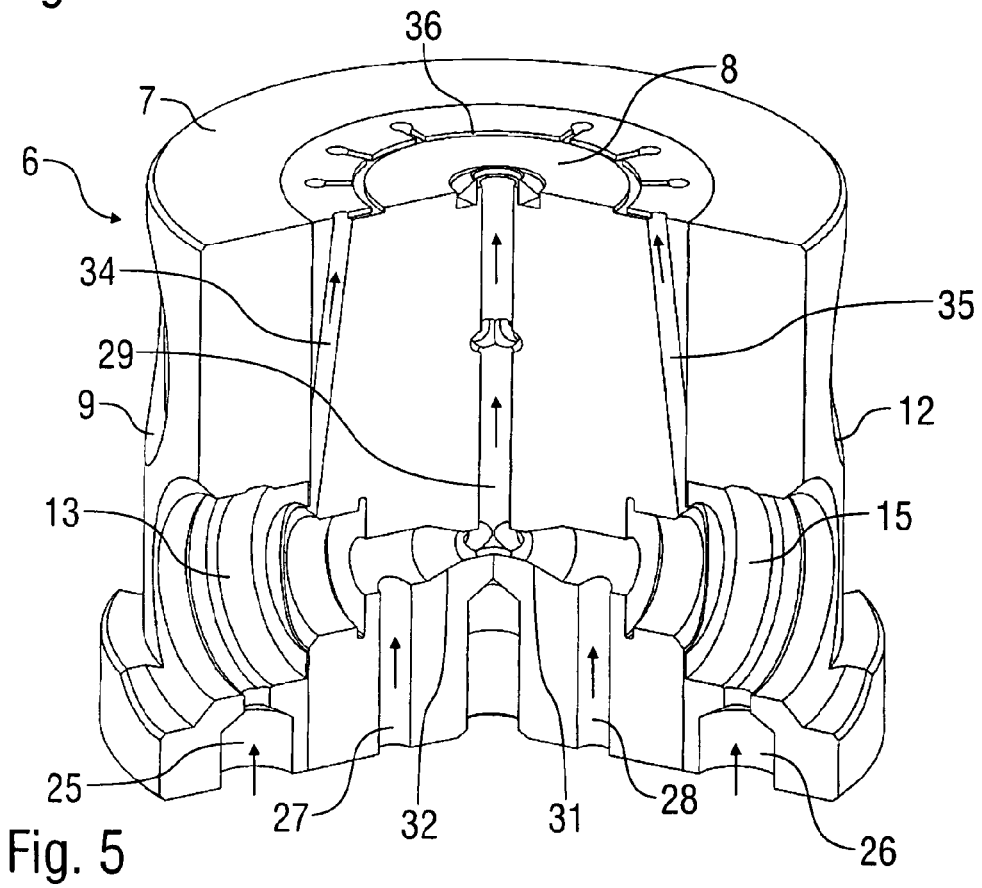
FIG. 5: a partially cut away perspective view of the exemplary valve unit from FIGS. 2 to 4, wherein no valve is inserted into the valve receptacles.

In the complete state of the valve unit 6, a plurality of valves 16-24 may be inserted into the valve receptacles 9-15, wherein the valves 16-24 are pneumatically actuated via control lines 25, 26 and control the feed from one coating agent supply line 27, 28 into a central coating agent channel 29 in each case, as can be seen in particular from the FIGS. 4 and 5. To this end, the individual valves 16-24 may have one valve needle 30 in each case, which is axially displaced by means of a corresponding pneumatic control via the control line 25, 26 and can optionally be pressed into a valve seat 31-32 or lifted out of the valve seat 31-32. In the valve position shown in FIG. 4, the valve needle 30 is pressed into the valve seat 32, as a result of which the valve needle 30 blocks the feed from the coating agent supply line 27 into the central coating agent channel 29. In this manner, by means of a suitable triggering of the valves 16-24, the feed from one of the coating agent supply lines 27, 28 can be enabled, as a result of which the desired colour is chosen.

Furthermore, the valve unit 6 may have a leakage line 34, 35 for each of the valve receptacles 9-15, wherein the leakage lines 34, 35 emanate from the associated valve receptacles 13 or 15 and open in the upper end face of the cylindrical housing core 8. An annularly surrounding collection channel 36 is located in this end face of the housing core 8, into which channel the individual leakage lines 34, 35 from all of the valve receptacles 9-15 open.

It may be advantageous for the housing core 8 to be formed of or include a different material than the housing jacket 7. This offers the advantage that the housing core 8 on the one hand and the housing jacket 7 on the other hand can be optimized with respect to the respective function during material selection.

A good material resistance of the media-conveying lines, such as for example the coating agent supply line 27, 28, the central coating agent channel 29 and the leakage line 34, 35 is important during the material selection for the housing core 8. Furthermore, it may also be advantageous during the material selection for the housing core 8 that the valve seat 31-32 located in the housing core 8 is not damaged during a cleaning of the housing and also otherwise has a satisfactory service life. The housing core 8 therefore consists of high-grade steel in this exemplary illustration.

By contrast, in the case of the material selection for the surrounding housing jacket 7, these considerations are less relevant. Rather, weight is relatively more important for the material selection for the housing jacket 7, such that a weight which is as low as possible is generally desired, so that the robot dynamic is not impaired by an excessively high weight of the rotary atomizer 1. In this exemplary illustration, the housing jacket 7 is formed of a plastic material (e.g. POM: polyoxymethylene).

Figure 6:
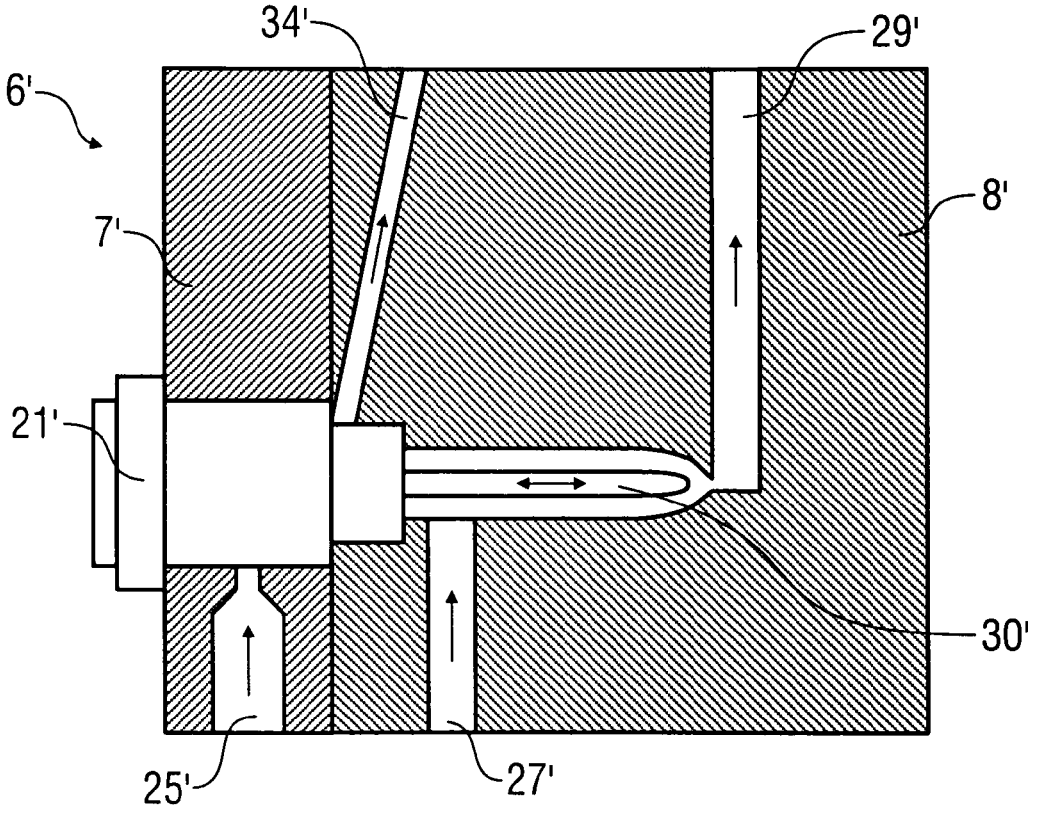
FIG. 6: a schematic cross-sectional view of a valve unit according to an exemplary illustration.

FIG. 6 shows an alternative exemplary illustration of a valve unit 6', wherein this exemplary illustration corresponds to the previously described exemplary illustration to some extent, so that to avoid repetitions, reference is made to the previous description, wherein corresponding reference numerals, which are merely provided with an apostrophe, are used in the following for corresponding details.

A distinctive feature of this exemplary illustration is that both housing parts 7', 8' are not arranged annularly, but rather next to or adjacent one another.

The exemplary illustrations are not limited to the previously described examples. Rather, a plurality of variants and modifications are possible, which also make use of the ideas of the exemplary illustrations and therefore fall within the protective scope. Furthermore the exemplary illustrations also include other useful features, e.g., as described in the subject-matter of the dependent claims independently of the features of the other claims.

Reference in the specification to "one example," "an example," "one embodiment," or "an embodiment" means that a particular feature, structure, or characteristic described in connection with the example is included in at least one example. The phrase "in one example" in various places in the specification does not necessarily refer to the same example each time it appears.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain examples, and should in no way be construed so as to limit the claimed invention.

Accordingly, it is to be understood that the above description is intended to be illustrative and not restrictive. Many examples and applications other than those specifically provided would be evident upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future examples. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary is made herein. In particular, use of the singular articles such as "a," "the," "the," etc. should be read to recite one or more of the indicated elements unless a claim recites an explicit limitation to the contrary.

LIST OF REFERENCE NUMERALS

1 Rotary atomizer
2 Bell cup
3 External charging ring
4 Connection flange
5 Housing
6 Valve unit
7 Housing jacket
7' Housing part
8 Housing core
8' Housing part
9-15 Valve receptacles
16-24 Valves
25, 26 Control lines
27, 28 Coating agent supply lines
29 Central coating agent channel
30 Valve needle
31-32 Valve seats
34, 35 Leakage lines
36 Collection channel

The invention claimed is:

1. A valve unit comprising:

a first housing part of a first material, the first housing part defining therewithin a central coating agent channel that extends to a first end face of the first housing part, the first housing part defining therewithin at least one coating supply line that extends to a second end face of the first housing part;

a second housing part of a second material, the first and second materials being different from each other, the second housing part defining therewithin at least one control line;

at least one valve receptacle extending through the second housing part and into the first housing part, the at least one valve receptacle having interfaces with the at least one control line, the at least one coating supply line, and the central coating agent channel, the at least one valve receptacle having a valve seat at the interface with the central coating agent channel; and at least one valve disposed within the at least one valve receptacle and having a needle, the needle being selectively operable to engage the valve seat and thereby inhibit fluid communication through the at least one valve receptacle between the at least one coating supply line and the central coating agent channel, wherein the first housing part is a housing core, the second housing part is a housing jacket, and the housing jacket surrounds the housing core, and wherein the first and second housing parts are coupled in a generally cylindrical shape, and the at least one valve receptacle is oriented radially with respect to the generally cylindrical shape.

2. The valve unit according to claim 1 wherein the first housing part is formed of a metallic material, and the second housing part is formed of a plastic.

3. The valve unit according to claim 1, wherein the first housing part is formed of a harder material than the second housing part.

4. The valve unit according to claim 1, wherein the first housing part is formed of a more abrasion resistant material than the second housing part.

5. The valve unit according to claim 1, wherein the first housing part is formed of a material that is more resistant to a rinsing agent than the second housing part.

6. The valve unit according to claim 1, wherein the first housing part is formed of a material that is more resistant to a paint than the second housing part.

7. The valve unit according to claim 1, wherein the second housing part is formed of an electrically insulating material, and the first housing part is formed of an electrically conductive material.

8. The valve unit according to claim 1, wherein the second housing part is formed of a lighter material than the first housing part.

9. The valve unit according to claim 1, wherein the second housing part is formed of a transparent material.

10. The valve unit according to claim 1, wherein the first housing part includes:

at least one leakage line in communication with the at least one valve receptacle, the at least one leakage line leading away from the at least one valve receptacle.

11. The valve unit according to claim 1, further comprising:

a plurality of valve receptacles, each of the valve receptacles configured to receive a single valve, each of the valve receptacles extending through the second housing part and into the first housing part, each of the valve receptacles oriented radially with respect to the generally cylindrical shape, wherein the first housing part defines a wall thickness between at least one pair of adjacent valve receptacles, the wall thickness being smaller than two millimeters.

12. The valve unit of claim 11, wherein the first housing part defines the wall thickness between each adjacent pair of valve receptacle to be smaller than two millimeters.

13. The valve unit according to claim 1, further comprising:

a plurality of valve receptacles, each valve receptacle being configured to receive a single valve, each of the valve receptacles oriented radially with respect to the generally cylindrical shape, the individual valve receptacles each having a single leakage line, the leakage lines of the individual valve receptacles extending within the first housing part.

14. The valve unit according to claim 13, wherein the leakage lines run at acute angles to a central axis of the valve unit, wherein the leakage lines extend away the individual valve receptacles and open in the first end face of the valve unit, and wherein an annular collection channel is arranged in the first end face of the valve unit, into which channel the leakage lines open.

15. The valve unit according to claim 1, wherein:

the at least one valve is fixed to the at least one valve receptacle, the at least one valve is pneumatically actuated, the at least one valve directly contacts the first and second materials of the first and second housing parts, the at least one coating material supply line, the central coating agent channel, and a leakage line are each defined by the first housing part, such that fluid passed therethrough directly contacts the first material, the valve unit has more than 4 valve receptacles, the valve receptacles each oriented radially with respect to the generally cylindrical shape, and the valve unit has a packing density of the valve receptacles, the packing density representing a ratio of the number of valve receptacles to the construction volume of the valve unit, wherein the packing density is greater than 0.01 cubic centimeters.

16. The valve unit according to claim 1, further comprising a plurality of valve receptacles and valves, and wherein:

the valve receptacles are each oriented radially with respect to the generally cylindrical shape, such that the valves are respectively oriented radially to the generally cylindrical shape in one of the valve receptacles, the valve receptacles are angularly spaced about a circumference of the generally cylindrical shape, the valve receptacles are arranged in a plurality of radially extending planes along a central axis of the generally cylindrical shape, the valve receptacles are arranged in adjacent planes in an angularly offset manner, a plurality of coating agent supply lines extend within the first housing part, wherein the valves each respectively control the feed from at least one of the coating agent supply lines into the central coating agent channel, the coating agent supply lines open out in the second end face of the first housing part, the second end face being opposite the first end face, and the central coating agent channel and the coating agent supply lines run axially within the generally cylindrical shape.

17. An atomizer with a structurally integrated valve unit according to claim 1.

18. The atomizer according to claim 17, wherein the valve unit forms an integrated colour changer including a plurality of colour inlets and one colour outlet.

19. The atomizer according to claim 17, wherein the valve unit forms a two-component mixer configured to supply a base paint and a hardener, the mixer configured to mix the base paint and the hardener in the atomizer.

* * * * *

UNITED STATES PATENT AND TRADEMARK OFFICE

CERTIFICATE OF CORRECTION

PATENT NO. : 9,061,310 B2
APPLICATION NO. : 13/634042
DATED : June 23, 2015
INVENTOR(S) : Bernhard Seiz It is certified that error appears in the above-identified patent and that said Letters Patent is hereby corrected as shown below:

In the claims:

Column 9, in line 23, replace "valve receptacle to be smaller" with -- valve receptacles to be smaller --.

Signed and Sealed this
Twentieth Day of October, 2015

Michelle K. Lee

Michelle K. Lee
*Director of the United States Patent and Trademark Office*